United States Patent [19]

Tellier

[11] 4,214,241

[45] Jul. 22, 1980

[54] PROXIMITY CONTROL SYSTEM

[76] Inventor: Joseph C. Tellier, 4005 Redden Rd., Drexel Hill, Pa. 19026

[21] Appl. No.: 526,037

[22] Filed: Mar. 11, 1944

[51] Int. Cl.[2] ..... G01S 9/02

[52] U.S. Cl. ..... 343/7 PF

[58] Field of Search ..... 250/1.31, 27.3, 1.3; 343/7, 8, 9, 12, 5, 7 PF

[56] References Cited

U.S. PATENT DOCUMENTS

| | | | |
|---|---|---|---|
| Re. 21,955 | 11/1941 | Chaffee | 343/14 |
| 1,432,022 | 10/1922 | Heisiny | 328/270 |
| 1,639,667 | 8/1927 | Ranger | 343/8 |
| 1,987,588 | 1/1935 | Drake | 343/12 |
| 2,231,929 | 2/1941 | Lyman | 343/16 |
| 2,399,426 | 4/1946 | Bradley | 343/7 ED |
| 2,402,464 | 6/1946 | Suter | 343/8 |
| 2,403,755 | 7/1946 | Rankin | 343/12 |

FOREIGN PATENT DOCUMENTS

| | | | |
|---|---|---|---|
| 38789 | 4/1931 | France | 343/14 |

*Primary Examiner*—Malcolm F. Hubler

*Attorney, Agent, or Firm*—Nathan Edelberg; Robert P. Gibson

EXEMPLARY CLAIM

1. In a proximity-controlled bomb adapted to be dropped upon a target and adapted to reach a fixed velocity, a fixed/radio-frequency control mechanism comprising a continuous wave radio transmitter and receiver operating at a fixed frequency and having a fixedly tuned network in common, an antenna coupled to said network, a detector coupled to said network for deriving a difference-frequency signal by heterodyning the transmitted wave and the wave reflected from said target, and means coupled to said detector and responsive to signal amplitudes derived only when said bomb and target reach a predetermined proximity.

2 Claims, 4 Drawing Figures

PROXIMITY CONTROL SYSTEM

Figure 1A:
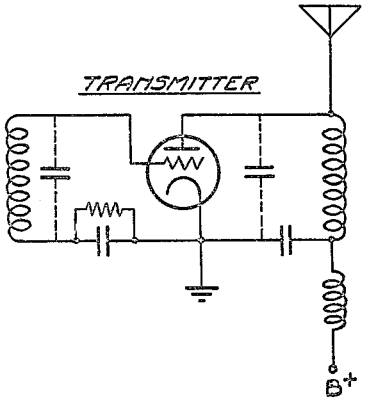

This invention relates to a system wherein radio waves are propagated from a moving vehicle (e.g.; an aerial bomb) toward an approaching objective, such as the earth, from which objective the waves are reflected back to a radio receiver on the aforesaid vehicle—which receiver functions as a result of being acted upon simultaneously by both the reflected waves and the waves coming directly from the transmitter.

More particularly, the subject invention has to do with improvements in a system of the above-stated character wherein the receiver functions by virtue of the fact that the reflected wave train has, effectively (due to the movement of the vehicle toward the reflecting objective) a higher frequency than that of the wave train which passes directly from the transmitter to the receiver—the latter being operative as a heterodyne detector to combine received wave energy of the two frequencies and thus produce a beat-frequency signal, which usually is of low frequency and is effective upon reaching a certain amplitude to actuate a controlled device.

In the operation of such a system it was found that objectionable and unintended frequency modulation of the transmitter output occurred as a consequence of mechanical vibration of the vehicle, and that the frequency of vibration and resulting modulation frequency unavoidably included the beat frequency to which the receiver was adjusted; and it was further discovered that because of sporadic dissonance between the transmitter and receiver, resulting from the aforementioned vibration, the tuned input of the receiver acted as a discriminator and thus, to a substantial extent, converted the frequency-modulated waves into hybrid (F.M. and A.M.) waves, amplitude modulated at the aforementioned beat frequency—whereof the beat-frequency component passed readily, after detection, through the beat-frequency selective network of the receiver and had the same effect as normally-produced beat frequency signal energy of like amplitude. Such an occurrence was, of course, apt to give rise to premature operation of the aforementioned controlled device, and often did so.

The immediately indicated procedure toward curing the above-recited defect was to try to stabilize the transmitter; but that could not be done economically because the operating frequency was extremely high—beyond the range of direct crystal control. Several frequency—multiplying stages would have been necessary in order to achieve stabilization through the use of a crystal; and that was found to entail too much complexity.

The present invention provides a complete solution of the difficulty and consists in the simple but effective device of so combining the transmitter and receiver that a single tuned network operates, at once, as the frequency determining part of the transmitter and as the tuned input of the receiver, so that all variations of transmitter output frequency are instantly and inherently accompanied by corresponding variations of the receiver input tuning, with the result that the receiver is incapable of detecting frequency modulation arising from transmitter frequency variations and, therefore, cannot produce spurious beat frequency waves as a consequence of such variations.

The invention has a considerable range of prospective application; but the system in connection with which it was first developed is one for controlling detonation of anti-personnel aerial bombs, and particularly one which causes the bomb to detonate at a predetermined height above ground. The transmitter and receiver are both very small and are housed within the bomb, and detonation is brought about as a result of the beat frequency wave reaching a prescribed critical amplitude—which latter is a function of the length of path traversed by the reflected wave before reaching the receiver and is, accordingly, a function of the height of the bomb above the earth or other wave reflecting medium toward which the bomb is directed.

When using the unimproved control system which immediately preceded the present invention it sometimes happened that bombs were detonated prematurely as a result of electrical impulses in the receiver output, which simulated the normal beat frequency signal but resulted from frequency modulation of the transmitter caused by vibration of the bomb in transit and effectuated by the innate and originally unsuspected aptitude of the receiver to respond to frequency modulation.

For the purpose of facilitating comprehension of the problem I have illustrated the bomb-control radio system which was employed prior to this invention and have followed this with circuit diagrams of modified systems incorporating the invention.

Figure 1B:
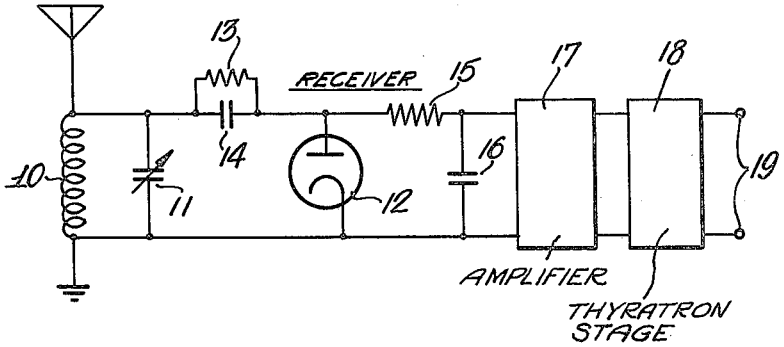
Figure 2:
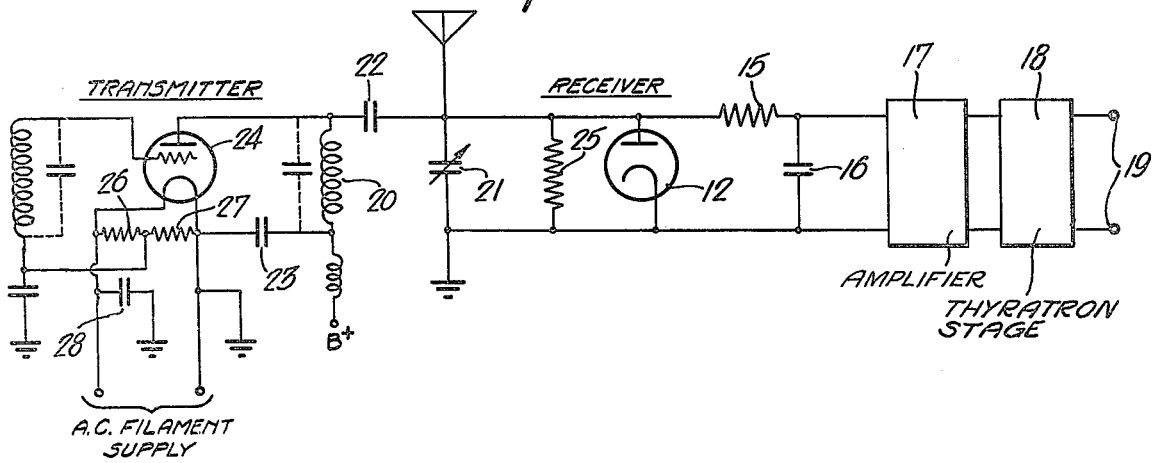
Figure 3:
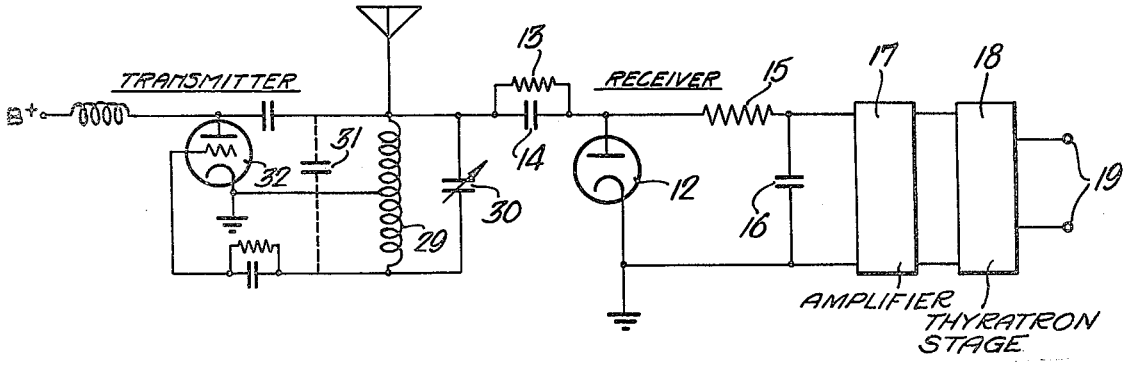

In the drawing:

FIGS. 1*a* and 1*b* depict, schematically, the transmitter and receiver, respectively, of a radio-control system which was in use prior to the present invention and with respect to which the present invention constitutes an improvement;

FIG. 2 depicts, schematically, an improved radio-control system incorporating the present invention; and FIG. 3 depicts a modified system incorporating the invention and employing a Hartley type oscillator.

The transmitter and receiver combination of FIGS. 1*a* and 1*b* was employed prior to this invention and is shown purely for the purpose of facilitating explanation of the deficiency against which the invention is directed. The transmitter is of the conventional tuned-grid-tuned-plate type and is designed to operate at such a high frequency that crystal control cannot be employed except by resorting to the use of frequency multipliers—which would entail objectionable complexities. The transmitter and receiver are mounted within the casing of an aerial bomb and the antennas are so designed that a high frequency radio beam is propagated from the bomb toward the earth or other objective from whence it is reflected back and picked up by the receiver antenna—which also is on the bomb.

Upon transpiration of a time interval following its release, and usually long before it reaches its objective, the bomb acquires a certain terminal velocity, by which is meant a maximum velocity of descent, which remains constant or substantially so throughout the remainder of the bomb's trajectory. Because of the fact that the bomb, during its flight, is continuously moving toward its objective the wave train propagated from the bomb arrives at the objective at a somewhat greater frequency than its frequency of generation; and, for like reason, the reflected wave train has a still greater frequency or, more accurately, apparent frequency when it impinges upon the receiving antenna on the bomb than it has upon leaving the objective at the commencement of its journey back to the bomb. There is, accordingly, a substantial difference between the frequency of the wave train which reaches the receiver via reflection from the objective and that of the wave train which reaches the receiver directly from the adjacent transmitter; and that diference (once the rate of descent has become constant) is a function of both the transmitter frequency and the aforementioned terminal velocity. By way of example, the frequency difference thus produced in a practical case might readily be of the order of say 200 c.p.s.; and said difference will, in all instances, be of a definite known value to the extent that the transmitter frequency is constant and of the designated value, provided the bomb has reached its terminal velocity.

The tuned input of the receiver is a tank circuit comprising an inductance 10 and condenser 11 and is tuned to the normal transmitter frequency. By "normal transmitter frequency" is meant the frequency at which the transmitter is adjusted to operate and would operate if not disturbed by extraneous influences such as mechanical vibration. Heterodyne conversion to produce a beat signal corresponding to the above-mentioned difference frequency is effected by means of a diode detector 12 which is connected across the tuned input circuit in series with a load resistor 13 and bypass condenser 14. The beat wave is selected by a low pass filter comprising a series resistance 15 and shunt condenser 16 and is passed therefrom to an amplifier 17 and thence to a thyratron stage 18. Output terminals 19 are connected to a suitable detonator.

Assuming that the transmitter frequency remains constant, the system of FIGS. 1*a* and 1*b* operates as follows: The descending bomb having acquired its characteristic terminal velocity, the corresponding beat frequency will be that which the low pass filter and amplifier are designed to pass with minimum attenuation; but the adjustment of the amplifier is such that its output is of insufficient magnitude to activate the thyratron until the bomb has approached to within some predetermined distance from the reflecting objective. When that point is reached the thyratron is activated and the bomb detonated.

In actual practice it was found that the transmitter frequency did not remain constant and it was further found that vibration of the transmitter tube brought about by vibration of the bomb in transit caused frequency modulation of the transmitter output. The vibration occurred over a wide range of frequencies including the aforementioned receiver beat frequency.

It is well known that a sharply tuned resonant circuit such as that comprising inductance 10 and condenser 11 will function as a discriminator when energized by a frequency-modulated wave having a center frequency corresponding to a point along the slope of its resonance curve. Hence, as will readily be understood, the frequency modulated waves picked up by the receiver directly from the transmitter were quite apt to include components capable of giving rise in the receiver to impulses of the chosen beat frequency which would pass through the filter just as readily as the normally produced beat signal; and it sometimes happened that such impulses would cause premature activation of the thyratron and correspondingly premature detonation of the bomb. The obvious remedy was to stabilize the transmitter, but, as previously intimated, that possible solution presented some serious practical difficulties in view of the physical conditions which obtained.

A modification of the above-described system in conformity with this invention, which has been developed and found to meet satisfactorily all requirements, including avoidance of the above-described deficiency, is illustrated diagramatically in FIG. 2. Here the tuned plate circuit of the transmitter includes an inductance 20 and tuning condenser 21 in series with blocking condensers 22 and 23 of large enough capacity, to have negligible impedance at the operating frequency. This circuit, together with the transmitter grid circuit and the interelectrode capacities of transmitter tube 24, determines the frequency of oscillation; and the entire frequency-determining transmitter network constitutes at the same time the tuned input of the receiver. If then, the output frequency of the transmitter is caused to deviate by any extraneous influence, such as vibration of the transmitter tube, the tuning of the receiver input is inherently altered in the same direction and to the same extent. Hence there is no tuned input circuit in the receiver of FIG. 2 which can possibly function as a discriminator to convert frequency-modulated wave trains from the transmitter into amplitude modulated wave trains. But, notwithstanding, the receiver tuned input of FIG. 2 is just as effective and just as selective as the tuned input of the receiver of FIG. 1*b*.

In FIG. 2 the detector load resistor 25 is connected in shunt to the tuning condenser 21 instead of in series therewith and the latter functions as a ratio frequency bypass as well as a tuning condenser.

The remaining components of the receiving system are identical with corresponding parts of FIG. 1*b*.

In certain installations according to FIG. 2 it was expedient to employ alternating current for heating the filaments, and it was necessary on that account to connect the oscillator tube grid return to the midpoint of a shunt resistance bridging the filament terminals. The use of such shunt resistances for the purpose of effecting midpoint grid connections is, of course, commonplace, but heretofore the practice has been to connect the plate return, as well as the grid return, to the midpoint of the shunt and to employ resistors of relatively low ohmic value which would not entail any serious wasteful loading of the plate circuit. Then, in order to obtain sufficient negative grid bias, it was the usual practice to insert in the grid circuit an additional biasing resistor of high ohmic value. Such resistors are not costly and are not large; but in this instance it was vitally important to eliminate every component that could be eliminated, and that consideration impelled me to the discovery that by making shunt resistors 26 and 27 each of high ohmic value and connecting the plate return directly to the filament terminals, instead of the midpoint, it was possible to omit the third resistor and still obtain the required negative grid bias without in any way adversely affecting the performance of the oscillator. This, I found, could be accomplished without the addition of any element which would offset the saving of the omitted resistor because the by-pass condenser 28 which serves to make possible the connection of the plate return to both filament terminals was essential in any event to optimum performance. The required negative grid bias in this instance called for a grid resistance of 23000 ohms—which was realized by making resistors 26 and 27 of 46000 ohms each.

FIG. 3 illustrates an alternative embodiment of the invention employing a Hartley type oscillator instead of the tuned-grid-tuned-plate oscillator of the previous figures. In this case, inductance 29 and condenser 30 constitute the tank circuit of the oscillator and at the same time the tuned input circuit of the receiver. These are, of course, supplemented by the distributed capacity 31 and the interelectrode capacities of transmitter tube 32 as well as the lead inductances. It is thought that no further observations need be made as to the mode of operation of the system of FIG. 3.

Manifestly any form of oscillator may be used whose operating frequency is determined by a resonant medium capable of being employed at the same time as the tuned input of the receiver.

It is thought to be self-evident that the transmitter and receiver could be located at a fixed position while the wave-reflecting objective is arranged to move toward or away from said position, or both; and it is obviously within the purview of the invention to arrange to have the controlled device activated when the length of the space path has increased to some predetermined measure.

What is claimed is:

1. In a proximity-controlled bomb adapted to be dropped upon a target and adapted to reach a fixed velocity, a fixed radio-frequency control mechanism comprising a continuous wave radio transmitter and receiver operating at a fixed frequency and having a fixedly tuned network in common, an antenna coupled to said network, a detector coupled to said network for deriving a difference-frequency signal by heterodyning the transmitted wave and the wave reflected from said target, and means coupled to said detector and responsive to signal amplitudes derived only when said bomb and target reach a predetermined proximity.

2. A radio-control system comprising means for transmitting a high-frequency radio wave of substantially constant frequency, said means including an oscillation generator, a fixedly tuned network arranged to determine the output frequency of the transmitting means and an antenna coupled to said network; a radio receiving circuit comprising a detector and an amplifier electrically coupled to said network and to said antenna so that the network serves also as the frequency determining input circuit for the detector, whereby the detector will receive wave energy directly from the oscillator circuit and also by reflection of the transmitted wave from any nearly reflecting object, through the common antenna; filter means between said detector and amplifier for passing detected energy only in a predetermined low-frequency range corresponding to the beat frequency between said transmitted and reflected frequencies due to a predetermined range of relative motion between said transmitting antenna and any reflecting object; and a translating device coupled to the output of said amplifier for responding to amplified beat-frequency energy.

* * * * *